US005988919A

United States Patent [19]

Kuo

[11] Patent Number: 5,988,919

[45] Date of Patent: Nov. 23, 1999

[54] LIPSTICK CASE

[76] Inventor: Jun-Hwei Kuo, 191 Lu Tong Road, Ding Tzu Li, Lu Kang Township, Chan Hua Hsien, Taiwan

[21] Appl. No.: 09/097,504

[22] Filed: Jun. 15, 1998

[51] Int. Cl.[6] ..... B43K 7/12

[52] U.S. Cl. ..... 401/117; 401/102

[58] Field of Search ..... 401/102, 117, 401/108

[56] References Cited

U.S. PATENT DOCUMENTS 5,102,248 4/1992 Welschoff ..... 401/50
5,339,483 8/1994 Byun ..... 15/184

FOREIGN PATENT DOCUMENTS 1118520 6/1956 France ..... 401/DIG. 1

*Primary Examiner*—Henry J. Recla
*Assistant Examiner*—Peter deVore
*Attorney, Agent, or Firm*—Harris & Egbert

[57] ABSTRACT

A lipstick case is composed of a tubular base, a tubular housing, a push rod, and a tubular cap. The tubular housing is fitted into the tubular base. The push rod is located at the bottom end thereof by a pillar at the bottom of the tubular base such that the push rod is received in the tubular housing. The push rod is provided at the top end thereof with a receptacle for holding the bottom end of a lipstick. As the tubular cap is lifted, the tubular housing is actuated to move up to shield the lipstick. The tubular housing can be turned back into the tubular housing to expose the tip of the lipstick.

1 Claim, 5 Drawing Sheets

LIPSTICK CASE

FIELD OF THE INVENTION

The present invention relates generally to lipstick, and more particularly to a lipstick case.

BACKGROUND OF THE INVENTION

The conventional lipstick case is defective in design in that a woman must use one hand to hold the tubular base of the lipstick case and another hand to turn the base to extract the lipstick to facilitate the application of the lipstick. In addition, the conventional lipstick case is provided with a tubular cap which can often cause a scratch on the lipstick at the time when the tubular cap is removed from the lipstick case.

SUMMARY OF THE INVENTION

The primary objective of the present invention is to provide an improved lipstick case free from the drawbacks of the conventional lipstick case.

In keeping with the principle of the present invention, the foregoing objective of the present invention is attained by a lipstick case having a tubular base, a tubular housing, a push rod, and a tubular cap. The tubular housing is fitted into the tubular base. The push rod is located at the bottom end thereof by a pillar at the bottom of the tubular base such that the push rod is received in the tubular housing. The lipstick is mounted on the top end of the push rod. As the tubular cap is lifted, the tubular housing is actuated to move up to shield the lipstick such that the lipstick is not scratched by the tubular cap.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
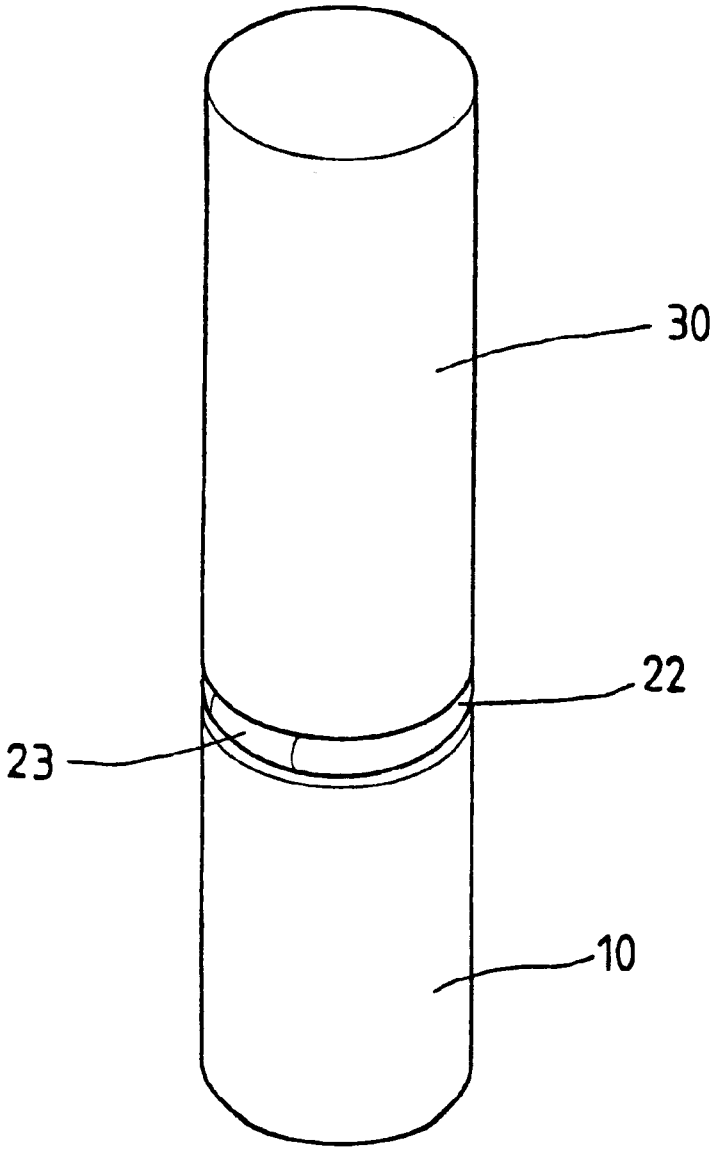
FIG. 1 shows a perspective view of a lipstick case of the present invention.
Figure 2:
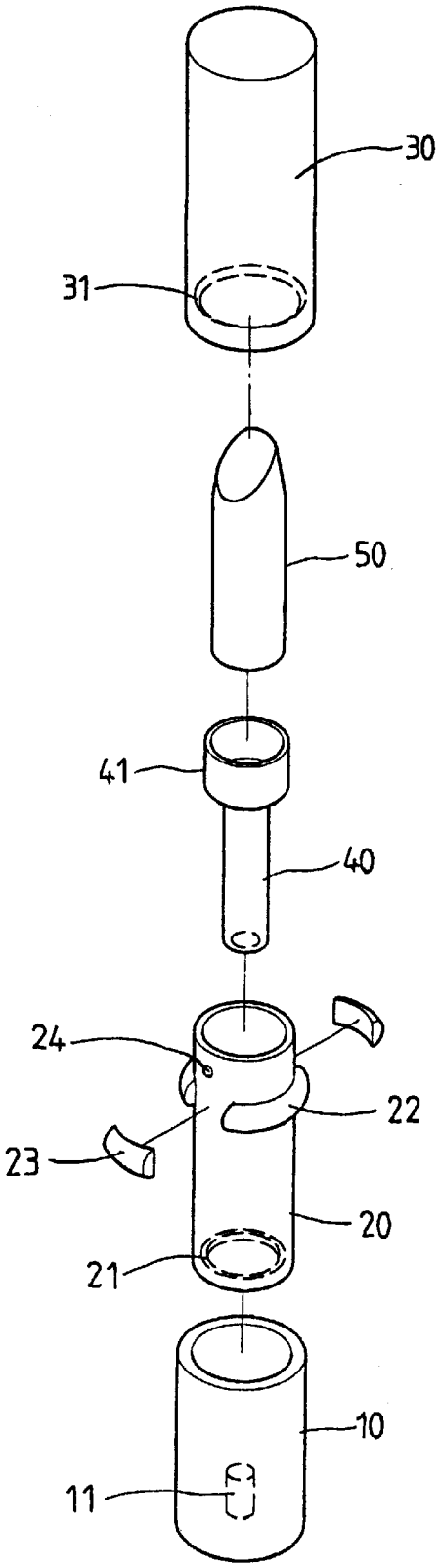
FIG. 2 shows an exploded view of the lipstick case of the present invention.
Figure 3:
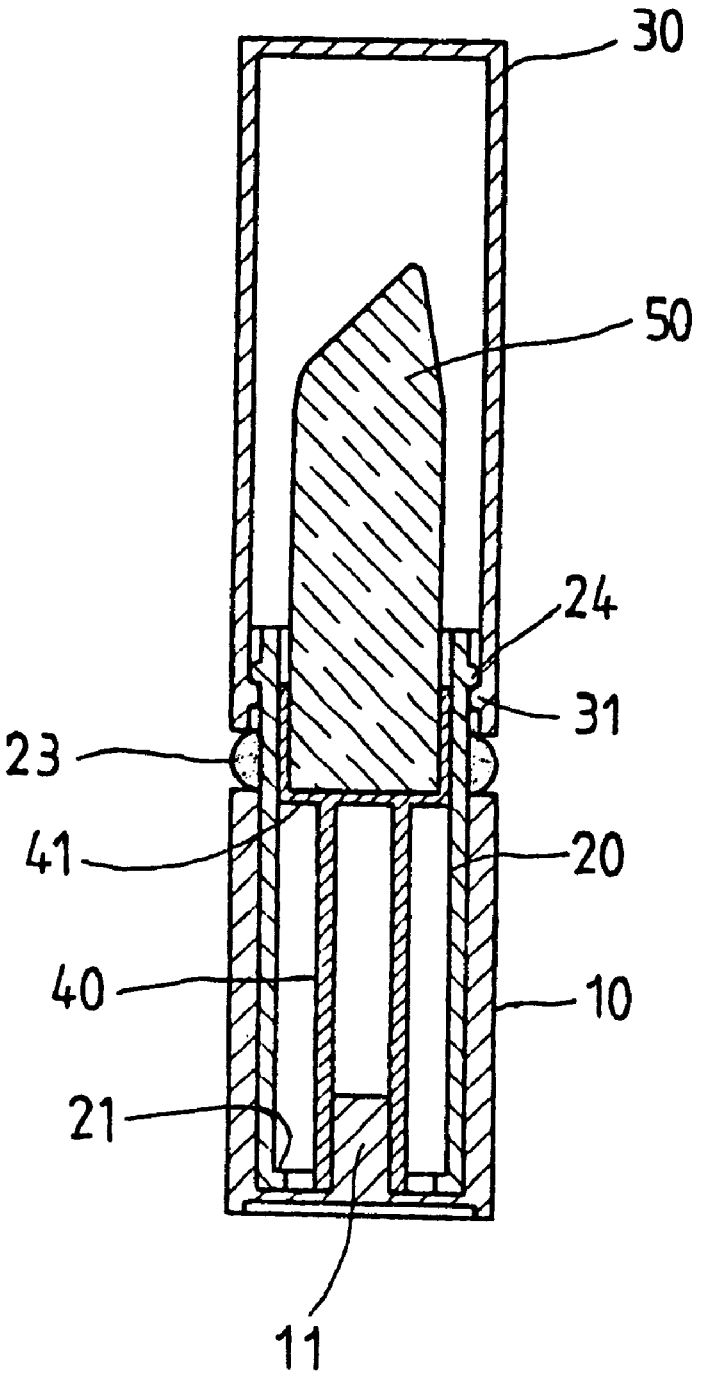
FIG. 3 shows a longitudinal sectional view of the lipstick case of the present invention.

As shown in FIGS. 1–3, a lipstick case embodied in the present invention is composed of a tubular base 10, a tubular housing, a tubular cap 30, and a push rod 40.

The tubular base 10 is of a hollow construction and is provided in the inner wall of the bottom end thereof with a retaining pillar 11. The tubular base 10 has an open top end.

The tubular housing 20 is of a hollow construction and is slidably fitted into the tubular base 10. The tubular housing 20 has an open top end and is provided in the bottom end wall thereof with a through hole 21. The tubular housing 20 is further provided in the outer wall of the top end thereof with two retaining projections 24 opposite in location to each other. Located under the retaining projections 24 are two decorative circular protuberances 22 and two decorative blocks 23.

The push rod 40 is provided at the top end thereof with a receptacle 41 for locating, the bottom end of a lipstick 50. The push rod 40 is received in the tubular housing 20 such that the hollow bottom end of the push rod 40 is fitted securely over the retaining pillar 11 of the tubular base 10.

The tubular cap 30 is of a hollow construction and is provided at the bottom end thereof with a through hole having a circular retaining groove 31 which is engaged with the retaining projections 24 of the tubular housing 20. The tubular cap 30 has a closed top end.

Figure 4:
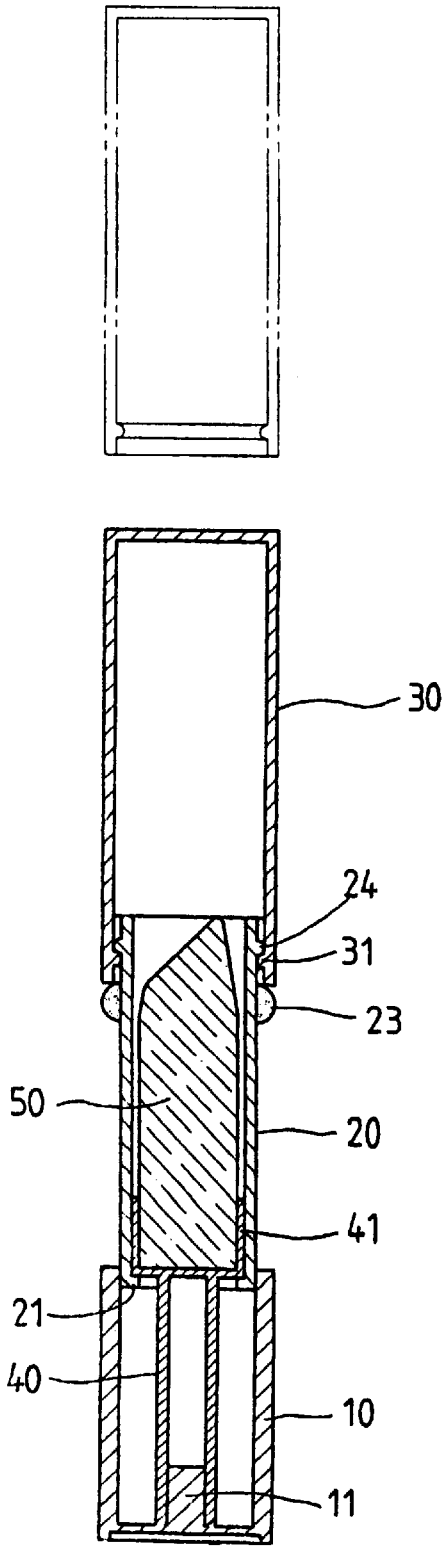
FIG. 4 shows a schematic view of the lipstick case of the present invention in operation.
Figure 5:
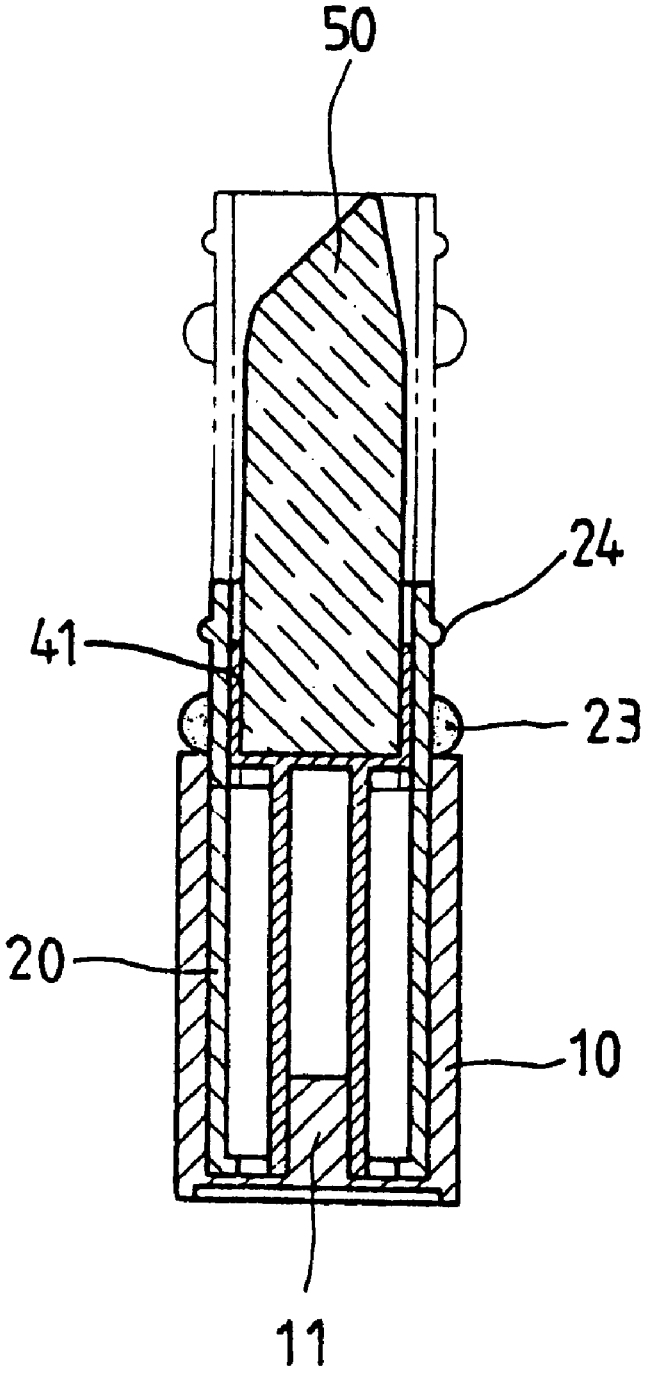
FIG. 5 shows another schematic view of the lipstick case of the present invention in operation.

As illustrated in FIG. 4, the cap 30 is lifted such that the tubular housing 20 is actuated to move up, and that the lipstick 50 is protected by the tubular housing 20. The tubular housing 20 can be forced into the tubular base 10 with fingers holding the decorative blocks 23 until the top end of the lipstick 50 emerges. Upon completion of applying the lipstick 50, the tubular housing 20 is pushed up to shield the top end of the lipstick 50 before the tubular cap 30 is joined with the tubular housing 20 such that the retaining groove 31 is engaged with the retaining projections 24 of the tubular housing 20. The tubular housing 20 can be pushed back into the tubular base 10 by the tubular cap 30, as shown in FIG. 5.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claim.

I claim:

1. A lipstick case comprising:

a tubular base of a hollow construction, said tubular base having a retaining pillar affixed to an inner wall of a bottom end thereof, said tubular base having an open top end;

a tubular housing of hollow construction and fitted slidably into said tubular base, said tubular housing having a through hole in a bottom end wall thereof, said tubular housing further provided in an outer wall of a top end thereof with two retaining projections and two decorative blocks;

a push rod provided at a top end thereof with a receptacle adapted to receive a bottom end of a lipstick, said push rod being received in said tubular housing such that a hollow bottom end of said push rod is fitted securely over said retaining pillar of said tubular base; and a tubular cap of hollow construction and having a through hole at a bottom end thereof, said tubular cap having a retaining groove formed therein, said retaining groove being detachably engageable with said retaining projections of said tubular housing such that an outward movement of said tubular cap causes said tubular housing to move outwardly from said tubular base and such that an inward movement of said tubular cap causes said tubular housing to move into said tubular base.

* * * * *